US005756155A

United States Patent [19]

Tzeng et al.

[11] Patent Number: 5,756,155

[45] Date of Patent: May 26, 1998

[54] COMBINATION NOZZLE AND VACUUM HOOD THAT IS SELF CLEANING

[75] Inventors: Chung-Hao Tzeng; Dong-Shiuh Cheng; Cherng-Yui Chang; Yung-Kai Lin, all of Hsin-chu, Taiwan

[73] Assignee: Taiwan Semiconductor Manufacturing Company, Ltd., Hsin-Chu, Taiwan

[21] Appl. No.: 589,694

[22] Filed: Jan. 22, 1996

[51] Int. Cl.[6] ..... B05D 3/00; B05B 1/28

[52] U.S. Cl. ..... 427/294; 427/421; 427/425; 118/326; 239/113; 239/120; 141/86; 141/93; 141/128

[58] Field of Search ..... 427/240, 294, 427/421, 425; 118/326, 302; 239/113, 105, 119, 120; 141/86, 93, 119, 120, 128, 115

[56] References Cited

U.S. PATENT DOCUMENTS

| | | | |
|---|---|---|---|
| 3,870,089 | 3/1975 | Laub, III | 141/44 |
| 4,093,123 | 6/1978 | Maran | 239/322 |
| 4,606,382 | 8/1986 | Biller et al. | 141/1 |
| 4,832,752 | 5/1989 | Nezworski | 134/22.12 |
| 5,147,087 | 9/1992 | Fuchs | 239/333 |
| 5,250,114 | 10/1993 | Konishi et al. | 118/321 |
| 5,255,720 | 10/1993 | McPherson | 141/86 |

*Primary Examiner*—Shrive Beck
*Assistant Examiner*—Michael Barr
*Attorney, Agent, or Firm*—George O. Saile; Stephen B. Ackerman; William J. Stoffel

[57] ABSTRACT

The invention provides a combination of a nozzle and a vacuum hood. The vacuum hood has a chamber that surrounds the tip of the nozzle and removes residue from the tip by a vacuum which flows in the chamber past the nozzle tip. This vacuum catches and removes residue from the nozzle tip and prevents the reside from interfering with the spraying action or dripping down. The method of the instant invention provides for dispensing a fluid from a nozzle without dripping fluid from the nozzle having a vacuum hood. The method comprises: (a) dispensing a fluid on a rotating semiconductor wafer through a nozzle over the wafer; (b) terminating the fluid flow through the nozzle; (c) creating an upward flow of gas about the dispensing nozzle when the flow of fluid through the nozzle is terminated; (d) capturing any fluid residue from the nozzle in the upward flow of gas; (e) removing the wafer and positioning another wafer; and (f) terminating the upward flow of gas; and repeating the process of steps (a) through (f).

13 Claims, 6 Drawing Sheets

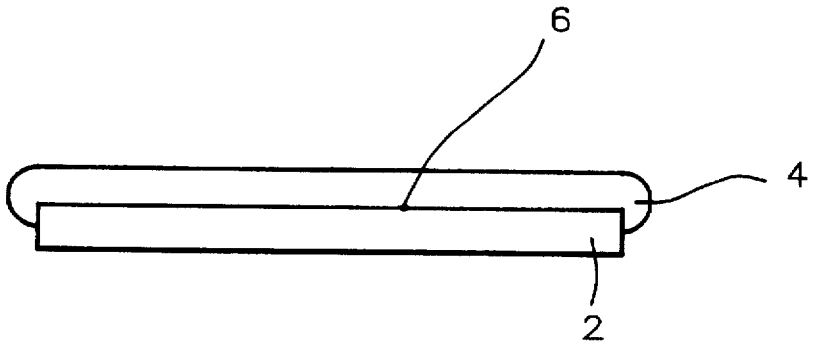
FIG. 1A – Prior Art
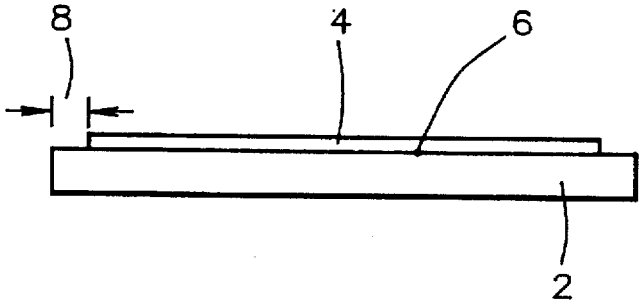
FIG. 1B – Prior Art
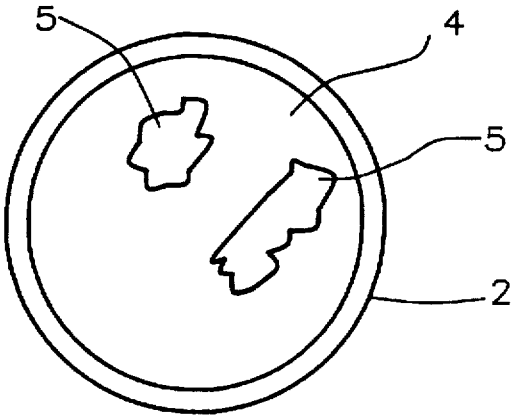
FIG. 1C – Prior Art

COMBINATION NOZZLE AND VACUUM HOOD THAT IS SELF CLEANING

BACKGROUND OF INVENTION

1) Field of the Invention

This invention relates generally to liquid spraying devices and particularly to a nozzle that is self cleaning and more particularly to a nozzle that has a vacuum hood which delivers a vacuum to remove residue from the nozzle and exterior of the nozzle.

2) Description of the Prior Art

Great improvements have been made to liquid and aerosol spraying nozzles over the last decade. Nozzles and sprayers have become very complicated, small, and efficient. However, in many applications nozzles spray liquids, aerosols, and suspensions of solids, etc., which can leave residues on the tip of the nozzle and on the outside of the nozzle. These liquid and solid residues can clog or partially block the nozzle. Also, these residues can drip from the nozzle onto critical parts thereby damaging the parts. For example, this occurs in the manufacture of semiconductor chips, and especially in the rinsing of photoresist from the top periphery of a wafer.

The problem of nozzles dripping residue and damaging product occurs in the rinsing of photoresist from wafers. A first photoresist layer is coated on a semiconductor wafer. Then in a photoresist rinse operation, the photoresist is rinsed away from the edge of the wafer. The photoresist is removed from the edge of the wafer because it will contaminate the equipment in the next process step. A rinse nozzle sprays thinner onto the edge of the spinning wafer to remove the photoresist from only the edge of the wafer. FIG. 1A shows a side view of a wafer 2 with a photoresist layer 4 covering the top side 6 of the wafer and also overhanging the edge of the wafer. FIG. 1B shows the photoresist layer rinsed off from the sides and top edge of the wafer. For example for a wafer with about a 150 mm diameter, about 2 and 3 mm of the photoresist would be removed from the edge 8. FIG. 1C shows the result of the problem when thinner drips from the nozzle onto a wafer. The photoresist 4 develops patches 5 where the wafers have to be reworked or destroyed. The small nozzle used in the photoresist operation exacerbates the drip problem.

Several methods have been tried to keep the nozzles clean. In U.S. Pat. No. 5,147,087 to Fuchs, after a spray medium is stopped from flowing through a discharge nozzle, a compressed air is flowed to clean out the inside of the nozzle. U.S. Pat. No. 4,093,123 to Maran, teaches a method which cleans out the inside of a paint sprayer by turning the paint spray can upside down, to halt the spray of paint and to flow air through the nozzle. In U.S. Pat. No. 4,832,752 to Nezworski, a nozzle cleaning method is disclosed using cleansing and deliming solution, for a washing machine application.

However, these devices and methods do not adequately solve the problem of nozzle discharge residues forming on the tip and on the outside of the tip. These residues can be liquid, combinations of liquids and solids, and solids. These residues can degrade the function of the nozzle by for example, clogging the nozzle tip or dripping from the outside of the nozzle tip onto some other work. There is a need to develop a nozzle device and method of dispensing fluids from a nozzle which prevents fluids from dripping from the nozzle.

SUMMARY OF THE INVENTION

It is an object of the present invention to provide an improved nozzle which is self cleaning of residue which forms on the nozzle tip surface and the outside of the nozzle.

It is an object of the present invention to provide an improved combination nozzle and vacuum hood which will pull a vacuum around the outside of the nozzle tip which will pull residue from the nozzle.

It is another object of the present invention to provide a method of spraying a wafer with a media without dripping media residue from the nozzle onto the wafer.

It is yet another object of the present invention to provide a method of spraying a wafer with a media using a nozzle having a vacuum hood without dripping media residue from the nozzle tip on to the wafer.

To accomplish the above objectives, the present invention provides an improved nozzle having a vacuum hood which pulls, by means of a vacuum, any residue from the tip of the nozzle. The invention provides a vacuum hood that removes residue from the tip of a nozzle thus preventing the residue from interfering with the spraying action or dripping down. The vacuum hood surrounds portions of the nozzle tip and has an opening to disperse fluid from the nozzle opening. The vacuum hood is connected to a vacuum source which pulls a vacuum thereby removing any residue from the nozzle.

Briefly, the invention comprises a combination of a vacuum hood and a nozzle having a nozzle opening for dispensing fluid. The combination comprises a vacuum hood having: (1) a chamber which surrounds portions of the nozzle opening; (2) a vacuum connection to a vacuum source; (3) an opening in said vacuum hood surrounding the nozzle opening. The cross-sectional area of the opening exceeds the cross-sectional area of the nozzle opening. A vacuum in the chamber removes residue from the nozzle.

The current invention also provides a method for dispensing fluid from a nozzle without dripping fluid from the nozzle. The method comprises (a) dispensing a fluid onto a rotating semiconductor wafer through a nozzle over the wafer; (b) terminating the fluid flow through the nozzle at the completion of the dispensing cycle, (c) creating an upward flow of air about the dispensing nozzle when the flow of fluid through the nozzle is terminated; (d) capturing any fluid residue from the nozzle in the upward flow of air, (e) removing the wafer and positioning another wafer; and (f) terminating the upward flow of air, and repeating the process of steps (a) through (f).

BRIEF DESCRIPTION OF THE DRAWINGS

The features and advantages of the combination nozzle and vacuum hood device according to the present invention and further details of a process of removing residue from a nozzle in accordance with the present invention will be more clearly understood from the following description taken in conjunction with the accompanying drawings in which like reference numerals designate similar or corresponding elements, regions and portions and in which:

FIG. 1A is a side view of a wafer covered with photoresist after a photoresist coat operation.

FIG. 1B is a side view of a wafer covered with photoresist where the photoresist on the edge and top periphery was successfully rinsed away.

FIG. 1C is a top plan view of a wafer covered a photoresist layer that has had thinner dripped on the resist causing patches 5 in the photoresist layer.

DETAILED DESCRIPTION OF THE PREFERRED EMBODIMENTS

Figure 2:
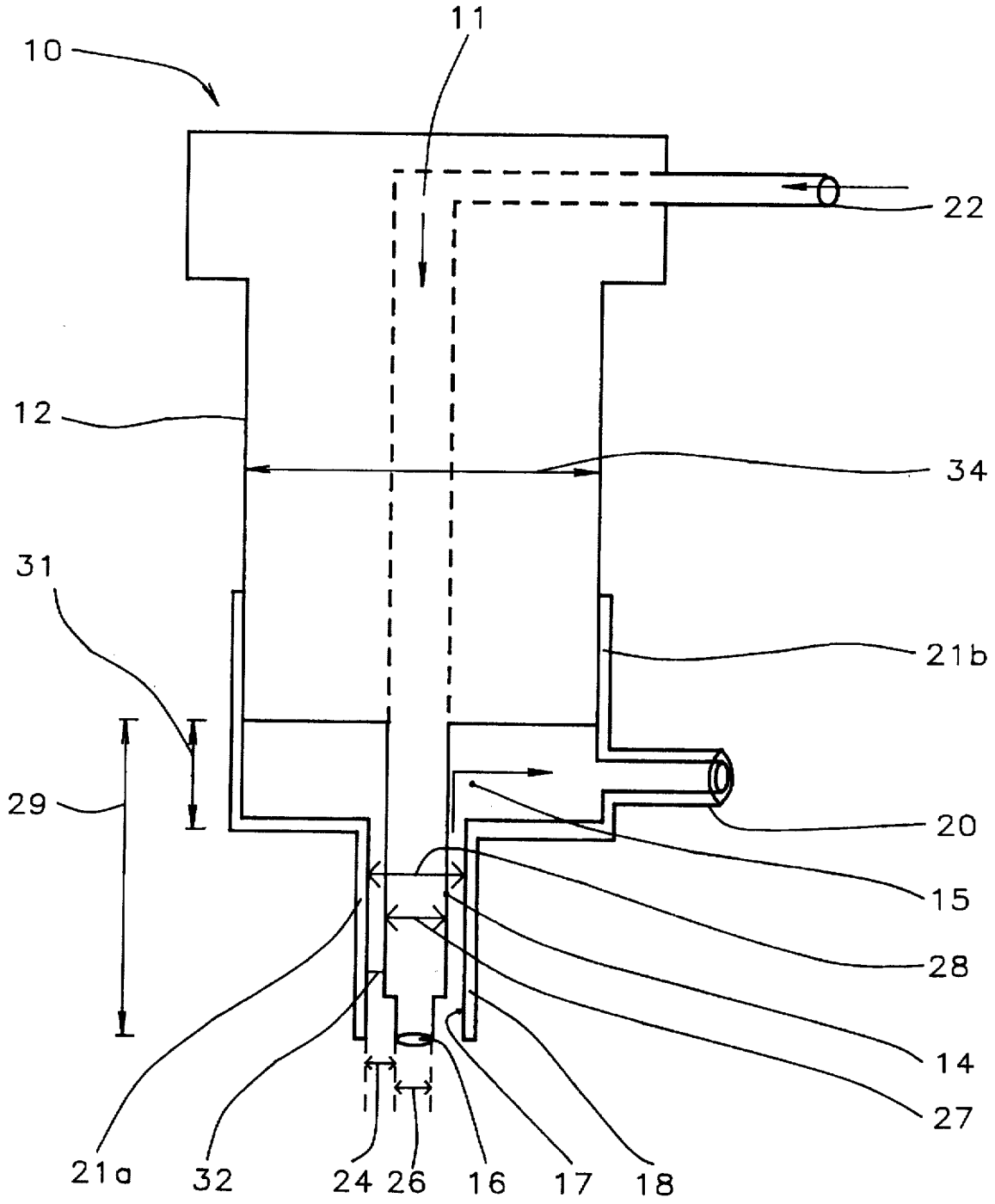
FIG. 2 is a schematic cross-sectional view of the combination of the vacuum hood and nozzle of the present invention.

The present invention will be described in detail with reference to the accompanying drawings. As shown in a preferred embodiment in FIG. 2, the present invention comprises a combination of a nozzle and a vacuum hood which captures residue from the nozzle in a vacuum which flows through a chamber 15 in the vacuum hood 18. The invention removes residue from the tip of a nozzle thus preventing the residue from interfering with the spraying action or dripping down. The vacuum hood 18 has: (1) a chamber 15 which surrounds the nozzle opening 16; (2) a vacuum connection 20 to a vacuum source; and (3) an opening 17 surrounding the nozzle opening 16. The cross-sectional area of the opening 17 exceeds the cross-sectional area of the nozzle opening 16. The opening 17 allows the fluid to be dispersed from the nozzle opening 16. The vacuum hood 18 is connected to a vacuum source by a conduit 20 which pulls a vacuum thereby removing any residue from the nozzle 10, nozzle tip 14 and nozzle opening 16. The nozzle of the invention can be used to spray fluid on a semiconductor wafer as describe below.

Figure 4:
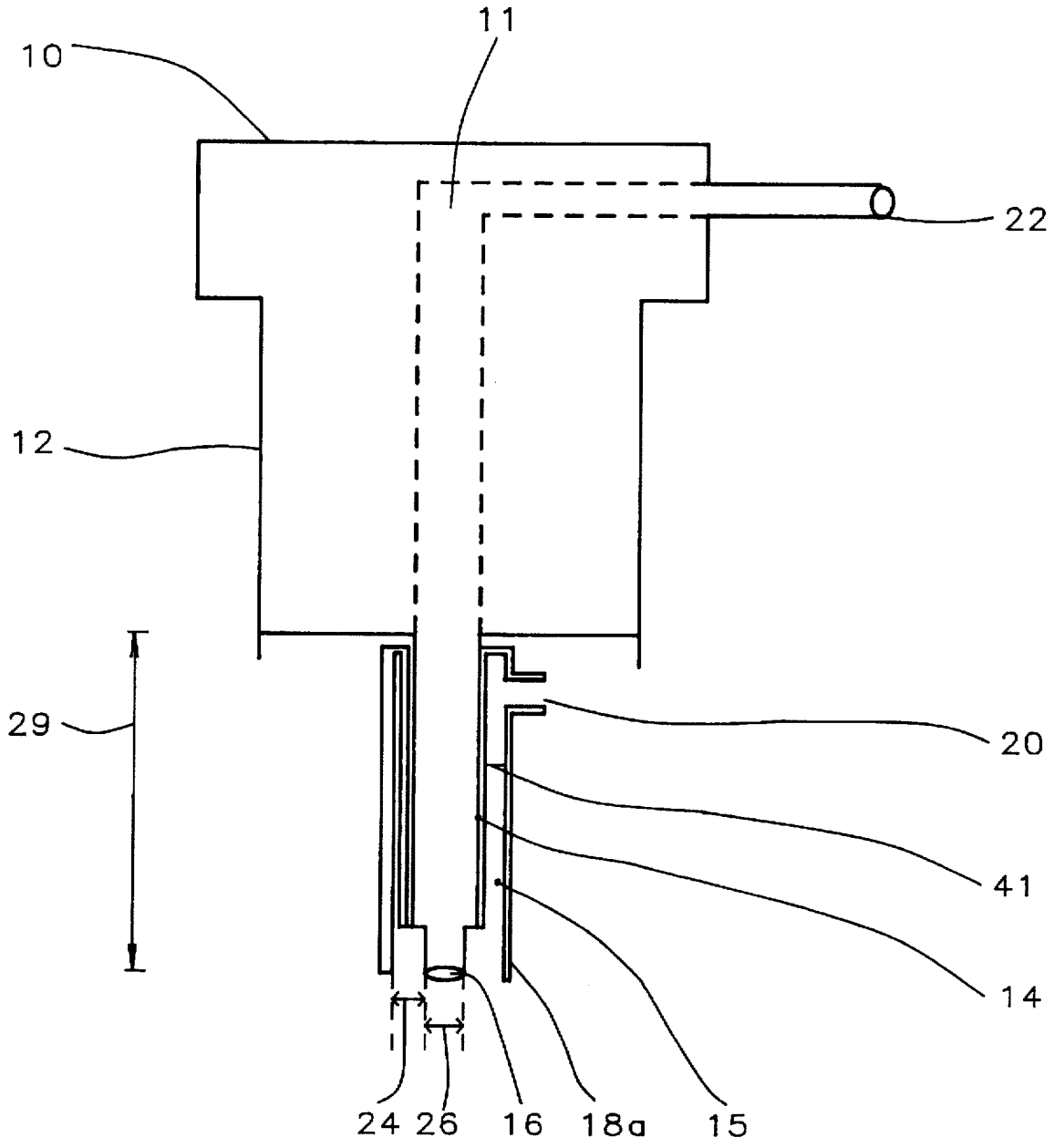
FIG. 4 is a schematic cross-sectional side view of another embodiment of the combination vacuum hood and nozzle of the present invention.
Figure 5:
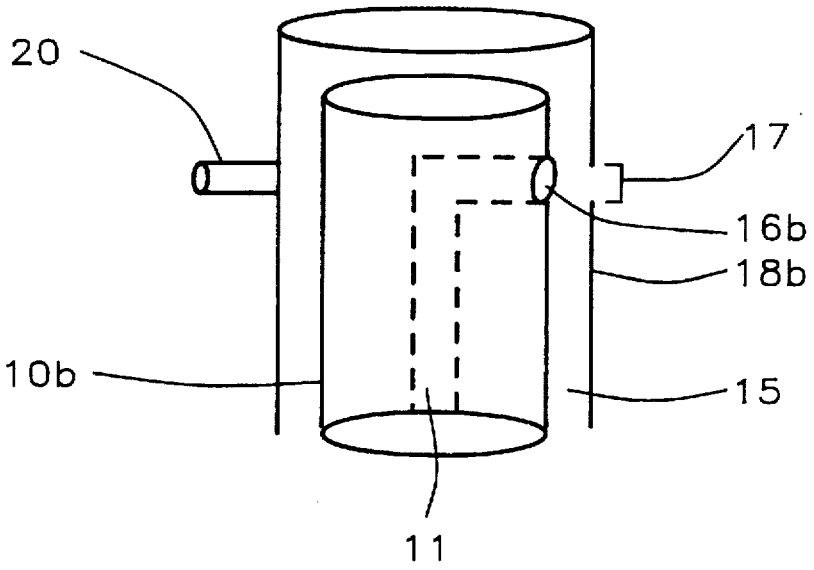
FIG. 5 is a schematic cross-sectional side view of another embodiment of the combination vacuum hood and nozzle of the present invention.

The nozzle 10 can have many configurations depending on the application. In a simple form, the nozzle 10 has a body 12 and a nozzle opening 16 from which spraying media are expelled. Several possible embodiments are shown in FIGS. 2, 4 and 5. In general, the invention comprises combination of a vacuum hood 18 and a nozzle 10 having a nozzle opening 16 for dispensing fluid.

In a preferred embodiment shown in FIG. 2, the nozzle includes a nozzle tip 14 preferably having a cylinder shape with a length 29 in the range between about 1 and 5 cm and an outer diameter 27 in the range between about 1 and 5 mm. The nozzle tip opening 16 preferably has a diameter 26 in the range of between about 0.01 and 0.2 mm and more preferably about 1.0 mm. The nozzle tip is preferably formed of stainless or polytetrafluoroethylene (e.g., Teflon®); and is preferably formed of polytetrafluoroethylene material.

The nozzle 10 has a cavity 11 communicating with a connection 22 to a fluid source and the nozzle opening 16. The nozzle has a nozzle body 12 or midsection preferably having a diameter 34 in the range of between about 0.2 to 2.0 cm and more preferably about 1 cm. Also, the body 12 preferably has an outside wall onto which a vacuum hood 18 can form a seal or be mounted to.

In general as shown in FIG. 2, the vacuum hood 18 comprises: (1) a chamber 15 which surrounds the nozzle opening 16; (2) a vacuum connection 20 to a vacuum source; and (3) an opening 17 in the vacuum hood surrounding the nozzle opening 16; the cross-sectional area of the vacuum hood opening 17 exceeding the cross-sectional area of the nozzle opening 16 whereby a vacuum in the chamber removes fluid residue and other material from the nozzle.

As shown in a preferred embodiment in FIG. 2, more specifically, the vacuum hood 18 has: (1) a cylindrical vacuum chamber 15 surrounding the nozzle tip 14 and the nozzle opening 16; the diameter of the cylindrical vacuum chamber 15 being greater than the diameter 27 of the nozzle tip 14; (2) a means to draw a vacuum in the vacuum chamber 15; and (3) an opening 17 surrounding the nozzle opening 16; the cross-sectional area of the opening 17 exceeding the cross-sectional area of the nozzle opening 16.

The vacuum hood 18 comprises cylindrical tube 21A and a base 21B. The cylindrical tube 21A has a chamber diameter 28 preferably in the range between about 0.2 and 1.0 cm and a spacing 32 between the inner wall of the hood 18 and the outer wall of the nozzle tip 14 preferably in the range of between about 0.5 and 5.0 mm. The vacuum chamber 15 has a diameter 28 about the nozzle tip 14 preferably in the range of between about 0.2 and 2.0 cm.

Still referring to FIG. 2, a vacuum hood 18 encircles the sides of the nozzle tip 14 and has an end opening 17 exposing the tip opening 16 of the nozzle. The vacuum hood 18 has a connection to a vacuum source 20. The vacuum source supplies a vacuum to the hood to pull off the residue from around the nozzle tip. The vacuum pressure near the nozzle is preferably in the range of between about 1 and 60 cm hg and more preferably about 200.00 cm hg. The distance 31 between the nozzle body from end and the nozzle tip 14 can be in the range of between about 0.3 and 1.0 cm and more preferably about 0.5 cm. In another embodiment (e.g., see FIG. 4), the nozzle tip has a narrow tip end wherein the distance 24 between the narrow tip end and the chamber wall 21A (e.g., cylindrical tube wall) in the range of between about 0.5 and 5.0 mm and more preferably about 1.5 mm. The vacuum hood is preferably formed of stainless steel, glass, or polytetrafluoroethylene and is more preferably formed of polytetrafluoroethylene material.

Figure 3:
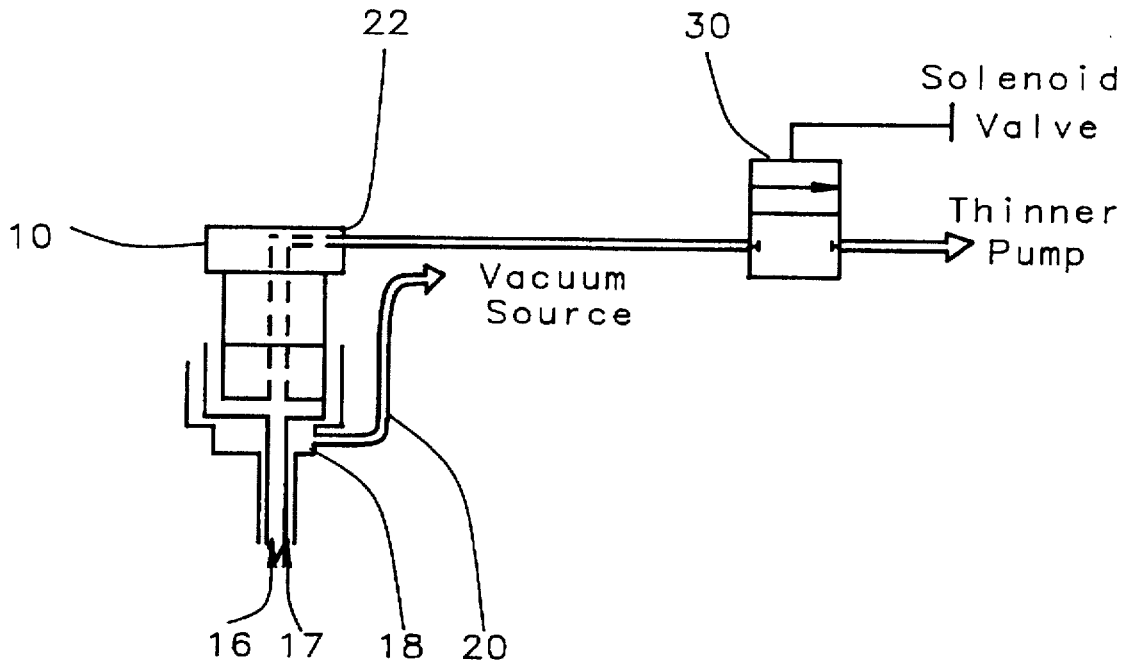
FIG. 3 is a schematic cross-sectional view of the combination of the vacuum hood and nozzle of the present invention showing the connections to a vacuum source and thinner source.

Referring to FIG. 3, another view of the nozzle and vacuum hood are shown. The vacuum hood 18 has a vacuum connection 20 linked to a vacuum generator. The spray media connection 22 is hooked to a media source, such as a thinner pump. The media (e.g., fluid) is regulated by an air valve 30 which is connected to a solenoid valve as shown in FIG. 3.

The base of the vacuum hood 21B can be sealed to the outside wall of the nozzle behind the tip to form a vacuum chamber as shown in FIG. 3. The vacuum chamber 15 or channel can be formed in many ways. The vacuum chamber can also be defined entirely by the vacuum hood as shown in FIG. 4.

Figure 7:
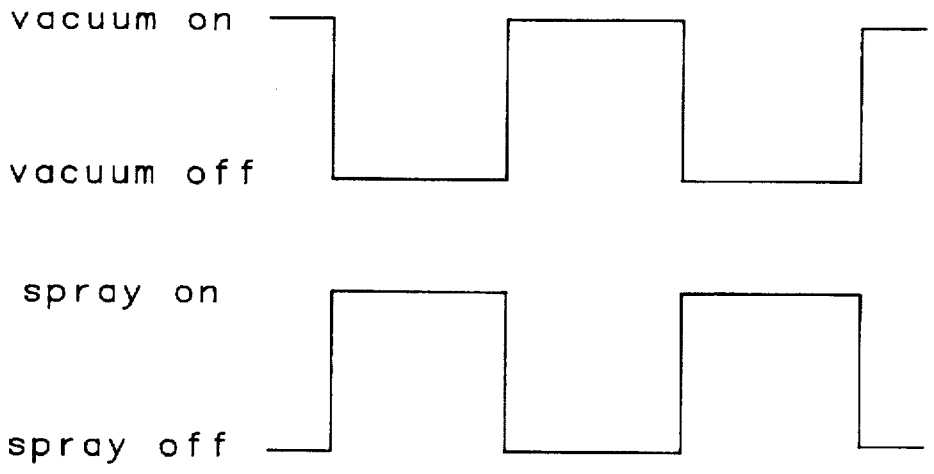
FIG. 7 is a diagram representing the synchronization of the fluid dispersion and vacuum in the vacuum hood for the method of the present invention.

The combination can further include a means to synchronize the vacuum source and a fluid source being dispensed through the nozzle opening. This means can be a combination of valves and electronic controllers (such as partially shown in FIG. 3). The proper synchronization between the vacuum and the fluid dispersion through the nozzle is discussed below and is shown in FIG. 7.

The vacuum hood can be removed for easy cleaning and modification. The vacuum hood can be easily installed on existing nozzles of many different types and for many applications.

The combination of the nozzle and the hood can include a means to draw a vacuum through the vacuum hood. The means can comprise a conduit between the vacuum chamber 15 and a vacuum source; and a valve in the conduit to control the vacuum in the vacuum chamber 15. The vacuum hood 18 can include a vacuum connection 20 as part of the conduit to connect to a vacuum source.

FIG. 4 shows an example of another embodiment of the vacuum hood 18A where the vacuum chamber 15 is formed from (e.g., defined by) the vacuum hood walls. Here, the vacuum hood 18A is formed of two joined concentric cylinders which slide over a nozzle. The vacuum chamber 15 can have width 41 in the range of between about 0.5 and 5 mm and more preferably about 2 mm. The vacuum hood 18A has a connection 20 to a vacuum source. The vacuum hood can extend out past the discharge opening of the nozzle tip to achieve additional vacuum pull. Other variations are possible, such as a channel formed by a combination of surfaces from the nozzle, the vacuum hood, and other objects, such as supports.

Referring to FIG. 5, another embodiment of the invention is shown where a different style nozzle and hood are used. Here the nozzle 10B has cylindrical shape with the discharge opening 16B on the side of the nozzle body. The vacuum hood 18B encircles a portion of the nozzle and has an opening 17 exposing the discharge opening 16B of the nozzle. The vacuum hood has a vacuum connection 20 to a vacuum source. Other variations are possible with the vacuum hood covering more or less of the nozzle. Also, many different shapes of nozzles can be covered with the vacuum hood.

In general, the invention's method of dispensing fluid from a nozzle having a vacuum means surrounding the nozzle opening without dripping fluid from the nozzle comprises: (a) dispensing a fluid on a rotating semiconductor wafer through a nozzle over the wafer; (b) terminating the fluid flow through the nozzle at the completion of the dispensing cycle; (c) creating an upward flow of gas about the dispensing nozzle when the flow of fluid through the nozzle is terminated; (d) capturing any fluid dripage from the nozzle in the upward flow of gas; and (e) removing the wafer and positioning another wafer; and (f) terminating the upward flow of gas; and repeating the process of steps (a) through (f). The vacuum (e.g., upward flow of gas) is preferably turned off then the nozzle is spraying and the vacuum is turned back on when the spray is off This way the vacuum does not interfere with the spray action of the nozzle.

The upward flow of gas creates a vacuum pressure between about 1 and 60 cm hg about the dispensing nozzle and more preferably about 20 cm hg. A vacuum source is used to create the flow of gas. A vacuum hood can be used to contain the flow of gas about the dispensing nozzle.

Figure 6:
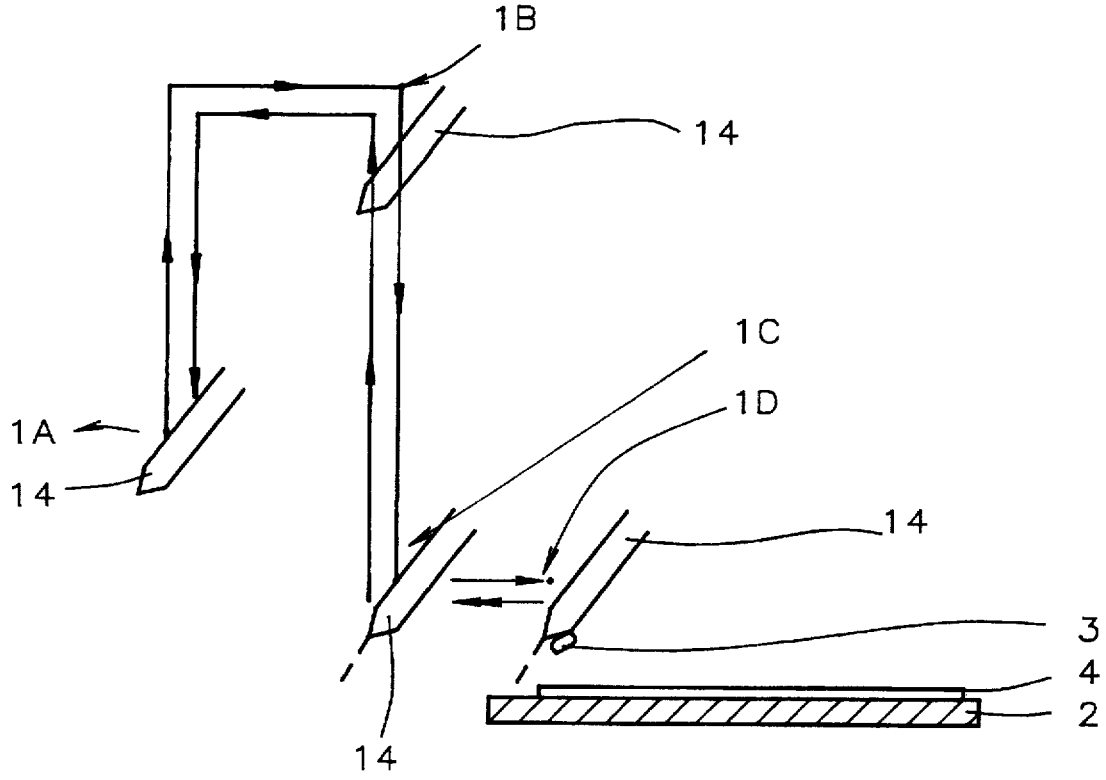
FIG. 6 is a schematic diagram of the movements of the nozzle during the spraying of photoresist from a semiconductor wafer in the method of the present invention.

Referring to FIG. 6, a photoresist rinsing process is schematically illustrated. The purpose of the rinse is to remove the photoresist from the top edge of a wafer. This process can be implemented on almost any wafer spraying operation and is preferably implemented on a TEL Mark-V wafer clean Track by Tokyo Electron Limited, 2-3-1, Nishi-Shinjuku, Shinjuku-Ku, Tokyo 163, Japan. For a wafer with about a 150 mm diameter, a photoresist width of about 2 and 3 mm is preferably removed from the periphery. Referring to FIG. 2, a wafer 2 is shown coated with a photoresist layer 4. The spray medium is can be any liquid or combination of liquid/gas or liquid/solid (e.g., a suspension). For example, water, thinner, acetone or other suitable organic solvents can be sprayed. The wafer is rotating and the nozzle tip 14 is moved as shown to spray the wafer.

The nozzle starts in position 1A when the wafer is first positioned for the rinse. With the vacuum on and the spray fluid off, the nozzle tip 14 is raised vertically and moves horizontally towards the wafer (position 1B) and then is lowered outside the edge of the wafer (position 1C). The vacuum is turned off and the spray fluid is turned on. Next, the nozzle tip 14 is moved horizontally towards and over the wafer (position 1D). The wafer is then sprayed with media (e.g., thinner) to remove the photoresist from the edge. Then the nozzle movements are reversed where the nozzle is horizontally moved back away from the wafer, raised at position 1C 10 with the spray fluid off and the vacuum on, moved away and back down to the starting position 1A.

During this operation, the nozzle moves vertically from the starting position (1A) a distance in the range of between about 1 and 10 cm and more preferably about 3.5 cm. Then the nozzle moves horizontally towards the wafer (position 1A to 1B) in the range of between about 5 and 10 cm and more preferably about 7 cm. Once the nozzle reaches position 1B, the nozzle moves down vertically a distance in the range of between about 1 and 10 cm and more preferably about 5 cm. Once the nozzle reaches position 1C, the nozzle mover horizontally towards the wafer (position 1D) with the spray fluid on in a distance between 1 and 3 cm and more preferably about 2 cm.

A problem with conventional nozzles is that media residue 3 falls from the nozzle onto the wafer creating the patches 5 shown in FIG. 3. The residue 3 can be shook from the nozzle during these movements and drips onto the wafer creating the patches.

The method of the instant invention uses a nozzle having a vacuum hood which removes spray media residue from the nozzle. The vacuum is preferably turned on only when the nozzle is not dispersing fluid as shown in FIG. 7. This is coordinated with the movements of the nozzle as describe above and shown in FIG. 6. When the nozzle is position immediately beside (position 1C) the wafer, the vacuum is turned off and the spray rinse is turned on. After the rinse is complete, the spray is turned off and the vacuum is turned on before the nozzle begins to rise. This ensures that any residue on the nozzle is removed before the tip is raised. The nozzle is then returned to its starting position 1A.

A common problem is where spray media drips or forms in a nozzle opening while the nozzle is waiting for the next wafer spray operation. By keeping the vacuum on during this rest period, any residue which forms is removed before the nozzle moves. Without the vacuum hood the media residue 3 would be thrown/dripped on the wafer as shown in FIG. 6 (position 1D) thus creating the patches.

The combination of the vacuum hood and nozzle of the instant invention provides an effective method of removing spray media residue from an opening in a nozzle and from the area around the discharge opening. The vacuum hood is inexpensive and will not interfere with the spray operation.

The method of the instant invention uses the above described vacuum hood to prevent fluid from dripping on a wafer. The method of turning on the vacuum when the spray is off and leaving the vacuum on during non-spraying periods is effective in preventing the medal dripping problem. In particular when the vacuum hood and method of the invention are implemented in a wafer photoresist rinse process, dripping and patch problems are eliminated. In one implementation on a TEL Mark-V wafer clean Track by Tokyo Electron Limited, 2-3-1, Nishi-Shinjuku, Shinjuku-Ku, Tokyo 163, Japan, the invention reduced wafer scrap from the dripping problem rate of 2 wafers defective out of 240 wafer=(0.83% defect rate). This problem elimination translates into substantial savings when the costs of scrap and rework are considered.

While the invention has been particularly shown and described with reference to the preferred embodiments thereof, it will be understood by those skilled in the art that various changes in form and details may be made without departing from the spirit and scope of the invention.

What is claimed is:

1. A method of dispensing fluid from a nozzle without dripping fluid from said nozzle; the method comprising:

(a) dispensing a fluid on a semiconductor wafer through a nozzle having a nozzle opening over said semiconductor wafer; said nozzle having an outer wall and a cavity inside said outer wall; said cavity connected with said nozzle opening; said nozzle opening facing downward; a vacuum hood around said outer wall of said nozzle; said vacuum hood having a hood opening exposing said nozzle opening;

(b) terminating said dispensing of said fluid through said nozzle;

(c) creating only an upward flow of gas in said vacuum hood around said nozzle opening and said outer wall of said nozzle when the flow of fluid through said nozzle is terminated;

(d) capturing any fluid residue from said nozzle opening in said upward flow of gas;

(e) removing said wafer and positioning another wafer; and (f) terminating the upward flow of gas; and repeating the process of steps (a) through (f).

2. The method of claim 1 wherein said upward flow of gas creates a vacuum pressure between about 1 and 60 cm hg around said nozzle.

3. The method of claim 1 wherein a vacuum source is used to create said flow of gas around a nozzle opening; and said flow of gas is confined by said vacuum hood; and step (a) further includes: the flow of fluid between said nozzle opening and said semiconductor wafer is unobstructed.

4. The method of claim 1 which further includes moving said nozzle over said wafer while dispensing said fluid on said wafer and moving said nozzle away from said wafer after said dispensing of said fluid is terminated.

5. A method of dispensing fluid from a nozzle without dripping fluid from said nozzle, the method comprising:

(a) dispensing a fluid over a semiconductor wafer by flowing fluid through a nozzle having a nozzle opening over said semiconductor wafer; said nozzle having an outer wall and a cavity inside said outer wall; said cavity connected to said nozzle opening; said nozzle opening facing downward; a vacuum hood around said outer wall of said nozzle; said vacuum hood having a hood opening exposing said nozzle opening; the flow of fluid between said nozzle opening and said semiconductor wafer is unobstructed;

(b) terminating said dispensing of said fluid through said nozzle (c) creating only an upward flow of gas in said vacuum hood around said nozzle opening and said outer wall of said nozzle when the flow of fluid through said nozzle is terminated;

(d) capturing any fluid residue from the nozzle opening in said upward flow of gas;

(e) removing said wafer and positioning another wafer; and (f) terminating the upward flow of gas; and (h) repeating the process of steps (a) through (f).

6. The method of claim 5 which further includes; after step (d) and before step (e) moving said nozzle away from said semiconductor wafer after said dispensing of said fluid is terminated; and after step (f) and before step (h) further includes moving said nozzle over said semiconductor wafer while dispensing said fluid on said wafer.

7. The method of claim 5 which further includes, a) said upward flow of gas created in said vacuum hood having:

(1) a chamber which surrounds said portions of said nozzle opening;

(2) a vacuum connection from said chamber to a vacuum source;

(3) said hood opening in said vacuum hood surrounding portions of said nozzle opening; the cross-sectional area of said hood opening is larger than the cross-sectional area of said nozzle opening whereby a vacuum in said chamber removes fluid from said nozzle.

8. The method of claim 5 which further includes, a) said upward flow of gas created in said vacuum hood having:

(1) a chamber which surrounds said portions of said nozzle opening;

(2) a vacuum connection from said chamber to a vacuum source;

(3) said hood opening in said vacuum hood surrounding portions of said nozzle opening; the cross-sectional area of said hood opening is larger than the cross-sectional area of said nozzle opening whereby a vacuum in said chamber removes fluid from said nozzle; and b) said nozzle includes a nozzle tip having a cylindrical shape with a length in the range between about 1 and 5 cm and an outer diameter in the range between about 1 and 5 mm and said chamber having a diameter about said nozzle tip in the range of between about 0.2 and 2 cm.

9. A method of dispensing fluid from a nozzle without dripping fluid from said nozzle; the method comprising:

(a) dispensing a fluid over an object through a nozzle having a nozzle opening over said object; said nozzle having an outer wall and a cavity inside said outer wall; said cavity connected with said nozzle opening; said nozzle opening facing downward; a vacuum hood around said outer wall of said nozzle; said vacuum hood having a hood opening exposing said nozzle opening; the flow of fluid between said nozzle opening and said object is unobstructed;

(b) terminating said dispensing of said fluid through said nozzle;

(c) creating only an upward flow of gas in said vacuum hood around said nozzle opening and said outer wall of said nozzle when the flow of fluid through said nozzle is terminated;

(d) capturing any fluid residue from the nozzle opening in said upward flow of gas.

10. The method of claim 9 wherein said nozzle includes a nozzle tip having a cylinder shaped with a length in the range between about 1 and 5 cm and an outer diameter in the range between about 1 and 5 mm and said vacuum hood having a diameter about said nozzle tip in the range of between about 0.2 and 2 cm.

11. The method of claim 9 wherein said object is a semiconductor wafer.

12. The method of claim 9 wherein said fluid is photoresist and said object is a semiconductor wafer.

13. The method of claim 9 which further includes, a) said upward flow of gas created in said vacuum hood having:

(1) a chamber which surrounds said portions of said nozzle opening;

(2) a vacuum connection from said chamber to a vacuum source;

(3) said hood opening in said vacuum hood surrounding portions of said nozzle opening; the cross-sectional area of said hood opening is larger than the cross-sectional area of said nozzle opening whereby a vacuum in said chamber removes fluid from said nozzle; and b) said nozzle having a nozzle tip having a cylindrical shape with a length in the range between about 1 and 5 cm and an outer diameter in the range between about 1 and 5 mm and said chamber having a diameter about said nozzle tip in the range of between about 0.2 and 2 cm.

* * * * *